US010812912B2

(12) United States Patent
Dinaburg

(10) Patent No.: US 10,812,912 B2
(45) Date of Patent: Oct. 20, 2020

(54) SPEAKER WITH DUAL DIFFUSER

(71) Applicant: Dinaburg Technology Corp., East Gwillimbury (CA)

(72) Inventor: Mikhail Dinaburg, Plano, TX (US)

(73) Assignee: Dinaburg Technology Corp., East Gwillimbury, ON (CA)

( * ) Notice: Subject to any disclaimer, the term of this patent is extended or adjusted under 35 U.S.C. 154(b) by 0 days.

(21) Appl. No.: 15/961,858

(22) Filed: Apr. 24, 2018

(65) Prior Publication Data

US 2020/0154209 A1 May 14, 2020

(51) Int. Cl.

| | |
|---|---|
| ***H04R 9/06*** | (2006.01) |
| ***H04R 9/02*** | (2006.01) |
| ***H04R 1/02*** | (2006.01) |
| ***H04R 7/12*** | (2006.01) |
| ***H04R 7/18*** | (2006.01) |

(52) U.S. Cl.

CPC ..... *H04R 9/06* (2013.01); *H04R 1/025* (2013.01); *H04R 7/12* (2013.01); *H04R 7/18* (2013.01); *H04R 9/025* (2013.01)

(58) Field of Classification Search

CPC . H04R 9/06; H04R 9/025; H04R 7/18; H04R 7/12; H04R 1/025

See application file for complete search history.

(56) References Cited

U.S. PATENT DOCUMENTS 2,231,479 A * 2/1941 Perry ..... H04R 7/122 381/186
3,772,466 A * 11/1973 Hossbach ..... H04R 1/2834 381/184
5,719,946 A * 2/1998 Terauchi ..... H04R 9/063 181/163

(Continued)

FOREIGN PATENT DOCUMENTS

| | | |
|---|---|---|
| CN | 205946151 U | 2/2017 |
| JP | 8289385 A | 11/1996 |
| JP | 2004 260 662 A | 9/2004 |

OTHER PUBLICATIONS

Dual Driver Speaker 74165110 Oct. 10, 2012.

*Primary Examiner* — Oyesola C Ojo

(74) *Attorney, Agent, or Firm* — Eugene F. Derényi; Fogler, Rubinoff LLP

(57) ABSTRACT

An improved loudspeaker is disclosed. The speaker includes at least one permanent magnet, an electromagnet and a diaphragm. The diaphragm has an inner portion (active portion) and an outer portion (stabilizing portion) that are both typically ring-shaped. The interaction between the magnets causes the inner portion to move back and forth according to the electrical signal inputted. As the inner portion moves forward, the outer portion tends to move backward relative to the inner portion. The movement of the active portion tends to produce corresponding forces on the stabilizing portion that cause the stabilizing portion to move and create sound in a symbiotic fashion. In certain embodi- (Continued)

ments, the portions move relative to each other as sound is produced so that a relatively constant volume of air is displaced on either side of the diaphragm thus minimizing acoustic distortion. The inner portion may be connected to the outer portion via a hinge and/or flexible material which allows the portions to move relative to each other.

16 Claims, 8 Drawing Sheets

(56) References Cited

U.S. PATENT DOCUMENTS

| | | | | |
|---|---|---|---|---|
| 6,445,803 | B1 * | 9/2002 | Boon | H04R 9/06 381/184 |
| 6,466,676 | B2 * | 10/2002 | Coffin | H04R 9/063 381/184 |
| 6,963,650 | B2 | 11/2005 | Combest | |
| 7,242,787 | B2 * | 7/2007 | D'Hoogh | H04R 9/025 381/412 |
| 9,042,582 | B2 * | 5/2015 | Chan | H04R 1/021 381/182 |
| 10,484,788 | B1 * | 11/2019 | Kudekar | H04R 1/2834 |
| 2005/0004629 | A1 * | 1/2005 | Gibson | A61N 1/375 607/60 |
| 2014/0029782 | A1 * | 1/2014 | Rayner | H04R 3/00 381/386 |
| 2015/0071481 | A1 * | 3/2015 | Little | H04R 31/003 381/398 |

* cited by examiner

SPEAKER WITH DUAL DIFFUSER

TECHNICAL FIELD

The subject matter described herein relates to audio equipment, and more particularly, to improved speaker technology compared to speakers known in the prior art.

BACKGROUND

A conventional loudspeaker (or speaker) is an electroacoustic transducer that converts an electrical signal representing audio into the corresponding sound.

Speakers of the prior art include at least one sound driver for producing sound that is typically housed in an enclosure known as a speaker cabinet/enclosure. Some speakers have more than one driver each of which may produce sounds in a particular frequency range, such as tweeters, mid-range drivers, woofers and so forth. The design and materials used by a speaker enclosure play an important role in the quality of sound produced by the driver(s). Heavy and expensive enclosure cabinets may be incorporated into speaker design in order to mitigate the phenomenon of acoustic short circuit and other issues. Acoustic short circuit refers to sound distortion and cancellation that occurs when sounds waves collide and/or are absorbed by other speaker components such as the enclosure which results in wasteful vibrations. Unfortunately, speaker enclosures that attempt to minimize sound distortions are often heavy and expensive, and results in very low efficiency of often under 5%, as a substantial portion of the sound energy is cancelled and/or converted to vibration. The low level of efficiency requires a much greater amount of energy in proportion to the actual sound produced which is wasteful and adds cost to the operation and maintenance of the speaker.

There is therefore a need for improved speaker technology that solves or mitigates at least one problem in the prior art.

BRIEF SUMMARY

By way of introduction, the invention includes various embodiments of an acoustic loudspeaker that are improvements over speakers of the prior art. Some embodiments of the claimed invention improve sound quality over prior art speakers, other embodiments improve energy efficiency over prior art speakers, and yet other embodiments improve both sound quality and energy efficiency compared to prior art speakers. Still other embodiments allow for a larger frequency range of sound to be outputted, thus reducing the need for additional components such as amplifiers, frequency splitters, and so forth.

In one aspect, the invention provides an acoustic speaker for converting an electrical signal into sound. The speaker includes at least one electromagnet and at least one permanent magnet. A diaphragm/cone is attached to the electromagnet which is typically contained in a housing. The terms diaphragm, cone and diffuser are used interchangeably herein. The diaphragm has an inner (active) portion/component and an outer (stabilizing) portion/component. The inner component may be attached to the outer component via a hinge mechanism and the outer component may be attached to a cradle (basket) via a hinge mechanism. The hinges allow the inner and outer components to travel independent of each other in the longitudinal direction that the components move (i.e. back/forth, front/back).

In typical usage, the interaction between the magnets causes the inner component to oscillate back and forth according to the electrical signal provided, which represents the desired sound. The outer component moves off-phase relative to the inner component. The term off-phase in this specification means that the components move relative to each other in opposing directions. For example, when the inner component moves forward, the outer component moves backward relative to the inner component. In some aspects, the volume of air displaced by the inner and outer portions at the front and back of the diaphragm remains substantially constant during movement. The effect is to substantially reduce acoustic short circuit and other distortions produced by speakers of the prior art. In some embodiments, the movement of the active portion causes air pressure changes within an enclosure and/or surrounding environment which in turn causes the stabilizing portion to move and thus create sound.

The portions of the diaphragm unit may be integrally connected or assembled separately. In some cases, the acoustic speaker may be mounted within a speaker enclosure for aesthetic reasons, ease of positioning, moving, performance reasons and so forth. The portions of the diaphragm are typically ring-shaped.

The present invention is defined by the following claims, and nothing in this section should be taken as a limitation on those claims. Further aspects and advantages of the invention are discussed below in conjunction with the preferred embodiments and may be later claimed independently or in combination.

DESCRIPTION OF THE DRAWINGS

The foregoing and other objects, features and advantages will be apparent from the following description of particular embodiments of the invention, as illustrated by the accompanying drawings in which similar reference number may refer to like parts throughout the different views, as will be determined by the context. The drawings are not necessarily to scale, emphasis instead being placed upon illustrating the principles of various embodiments of the invention.

DESCRIPTION OF THE INVENTION

Figure 1:
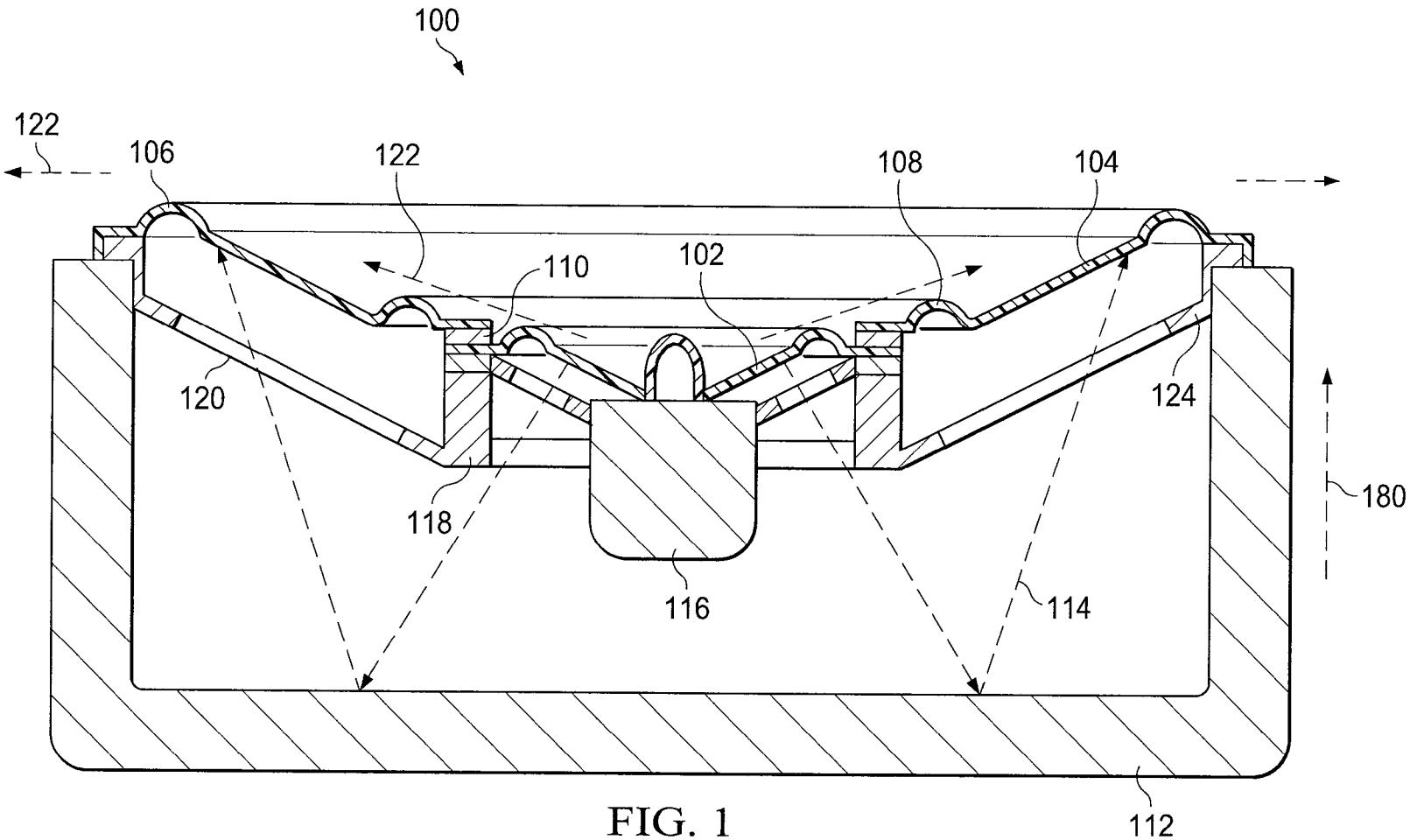
FIG. 1 is a top-down cross-sectional view of a speaker of the invention showing various components, according to an embodiment.

Referring first to FIG. 1, an exemplary acoustic speaker 100 is illustrated via a top-down cross-sectional view. As shown, the speaker 100 includes a speaker driver 116, a speaker enclosure 112, and a diaphragm (cone) having an inner (active) portion 102 and an outer (stabilizing) portion 104. Both the inner portion and outer portions may be shaped as an annulus (ring) having a desired width. Hinges 108 may separate the inner portion from the outer portion so that the portions may move relative to each other as the inner portion is driven back and forth via the driver that contains at least one electromagnet. The outer edge of the inner portion is approximately the same diameter as the inner edge of the outer portion, the difference in diameter defined by substantially the hinge mechanism. The outer edge of the outer portion may be affixed to a cradle 120 via a hinge as well so that the outer portion may move relative to the cradle which is typically stationary during operation.

As sound is produced, the inner and outer portions are configured to move back and forth substantially along the axis defined by arrow 180. The portions move off-phase relative to each other, meaning that, if one portion is positioned in the forward direction (i.e. in the direction of arrow 180), the other portion is positioned in the rear direction (i.e. opposite of arrow 180). The forces created by the active part of the diffuser tend to move the stabilizing portion in the opposite direction that the active portion is driven. This allows the stabilizing portion to create sound by capturing and utilizing sound energy created by the active portion. In some embodiments, the volume of air displaced on either side of the diffuser during movement is relatively consistent. By leveraging the forces created by one portion of the diffuser to move the other portion in the opposite direction, sound distortion is substantially reduced which allows accurate sound to be produced without the need for expensive enclosures and/or other sound equipment.

Figure 2:
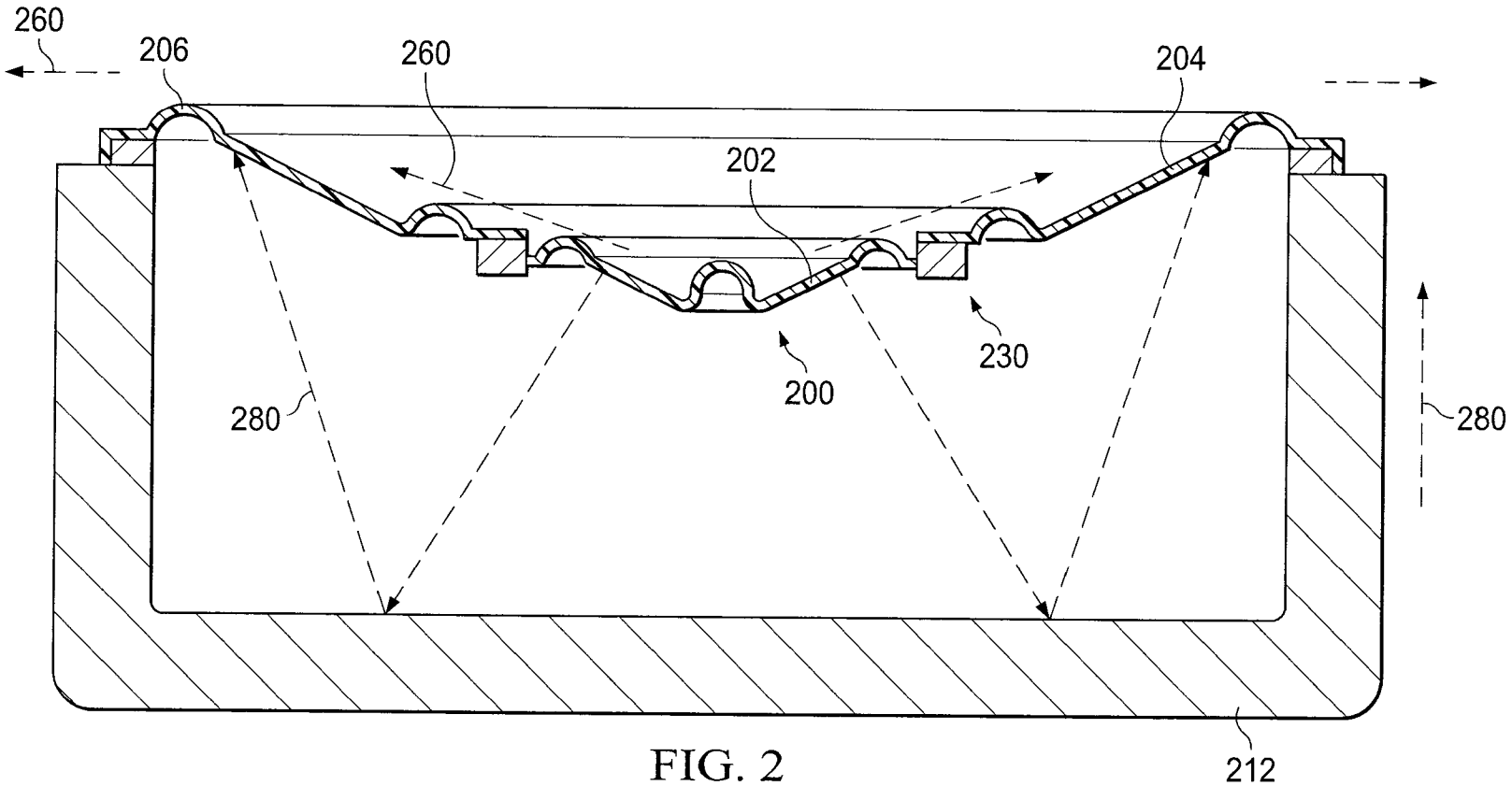
FIG. 2 is a top-down cross-sectional view of an exemplary cone that may be used in a speaker of the invention, according to an embodiment.

Referring to FIG. 2, an exemplary diaphragm of the invention is illustrated within a speaker cabinet. Other components such as the cradle for holding the diaphragm, the permanent magnet and electromagnet are omitted from this diagram for ease of illustration. A person skilled in the art will readily understand that many implementations of conventional speaker design may be used with various embodiments of the invention that include a diaphragm having an active portion and a stabilizing portion.

The diaphragm 200 includes an inner component (active part) 202 and an outer component (stabilizing part) 204. The diaphragm components are separated via a hinge mechanism that allow the components to propagate in the directions defined by the axis of arrow 280. In typical usage, as the driver (shown in FIG. 1) produces sound,
the active portion is driven back and forth according to the electrical input signal. The forces created by the movement of the active portion tend to cause the stabilizing portion to move in the opposite direction that the active portion moves. For example, if the active portion 202 is driven in the direction of arrow 280, the forces created by this movement cause the stabilizing portion 204 to move in the opposite direction. The forces that operate on the stabilizing portion include acoustic pressure and the pressure the stabilizing portion is exposed to from within the enclosure and/or the surrounding environment. The dual diffuser design allows the forces created by the active portion to create useable sound by causing the stabilizing portion to move in the opposing direction, unlike speakers of the prior art that tend to waste this energy through vibrations and cancellation. In some embodiments, the effect is to displace a relatively constant volume of air on either side of the diaphragm while its components move back and forth.

In some embodiments that incorporate a speaker enclosure (such as in FIG. 2), the movement of either component in the direction of the back of the enclosure creates a corresponding force in the opposite direction against the other portion. For example, when the active portion is driven towards the rear of the speaker enclosure, the application of Boyle's Law (PV=constant) ensures that the volume of air remains relatively constant. Because movement of the active portion will tend to increase the pressure momentarily, the stabilizing portion will tend to move toward the front of the speaker ensuring that the volume of air within the speaker is relatively constant (and the pressure is relatively constant as well). A person skilled in the art will recognize that the relationship defined by Boyle's Law, and leveraged by embodiments of the invention, is an approximation given that the enclosure may not be completely airtight. The operation of forces on the components of the diaphragm is described in more detail with respect to FIG. 7.

Figure 3:
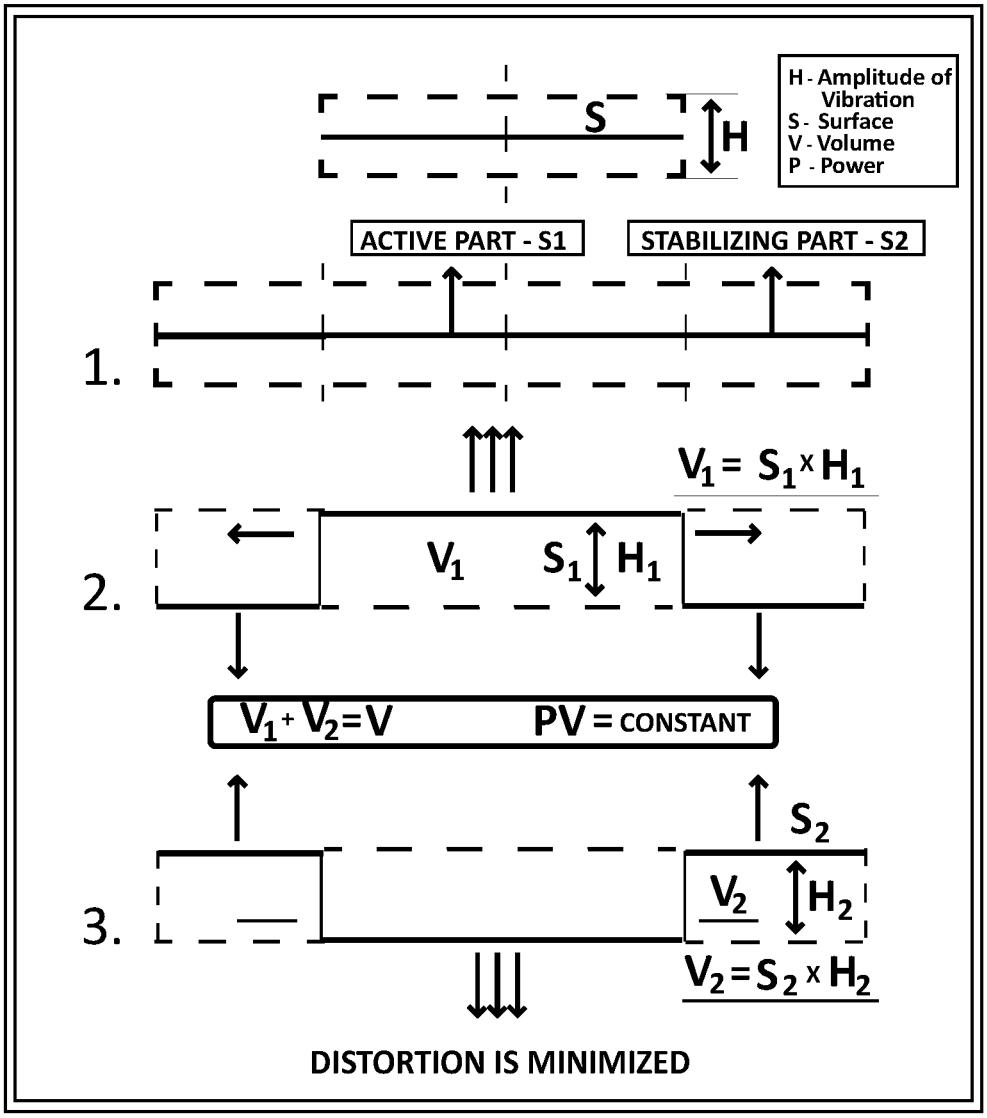
FIG. 3 is a transition diagram showing some components of an exemplary speaker cone of the invention in various positions as the driver produces sound, according to an embodiment.

FIG. 3 illustrates a phase transition diagram showing the relative movement of the inner and outer portions of the diaphragm, and in general terms, that the volume of air displaced on either side of the diaphragm may be relatively constant in operation. Numbers 1, 2 and 3 indicate the different relative positions of the components of the diaphragm as sound is produced. It should be noted that illustrations 1, 2 and 3 reflect the positions of the inner and outer portions of a diaphragm at one particular moment in time. In phase 1, the active part S1 (i.e. inner portion) and the stabilizing part S2 (i.e. outer portion) are positioned on the same plane. As the interaction between the magnets causes the active part to move in the direction as shown in position 2, the stabilizing part moves in the opposite direction. As shown, the volume of air displaced by the active part (V1) is approximately equal S1×H1 (i.e. the distance the active part moves multiplied by the width of the active part). Likewise, the stabilizing part S2 will be driven in the opposite direction as a result of the pressure within the enclosure and forces created by the active part. The volume of air displaced by the stabilizing part S2 (V2) is approximately the same as that displaced by the active part. The active and stabilizing portions' freedom of movement allow the invention to utilize Boyle's Law by ensuring that any increase in pressure by one portion of the diaphragm automatically creates an opposing force on the other portion such that the volume within the enclosure remains relatively constant.

Phase 3 illustrates the opposite situation in which the active part has moved backward (i.e. away form the rear of the enclosure) thus creating an increase in volume and decrease in pressure in the enclosure. As described with respect to FIG. 7, the pressure within the local environment may tend to force the stabilizing portion toward the rear of the enclosure; however, additional forces may also tend to force the stabilizing portion toward the rear of the enclosure in some embodiments as well.

In this way, by ensuring a relatively stable volume of behind the speaker diaphragm (within the enclosure), embodiments of the invention are able to substantially minimize acoustic short circuit and/or other distortions that affect speakers of the prior art.

Figure 4:
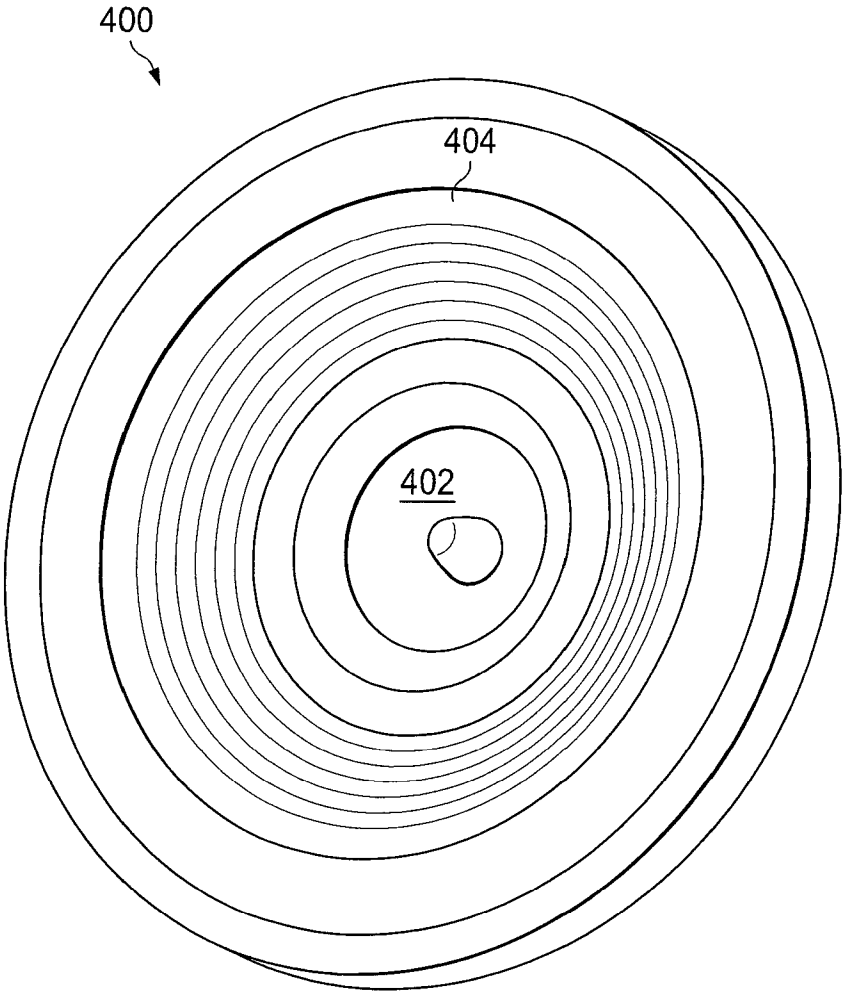
FIG. 4 shows an exemplary speaker cone of the invention, according to an embodiment.

FIG. 4 shows an assembled speaker driver and diaphragm unit 400 which is configured to create quality sound with or without a speaker enclosure. The active portion is indicated by reference numeral 402 and the stabilizing portion is indicated by reference numeral 404. As described herein, embodiments of the invention leverage the acoustic energy produced by the active portion of the diaphragm, and the pressure dynamics of the environment, to create a corresponding force in the opposite direction on the stabilizing portion of the diaphragm. Embodiments of the invention are thus able to create quality sound with a broader frequency range and minimal distortion even without a speaker enclosure, although a speaker enclosure may be incorporated into various embodiments for performance or other reasons.

Figure 5:
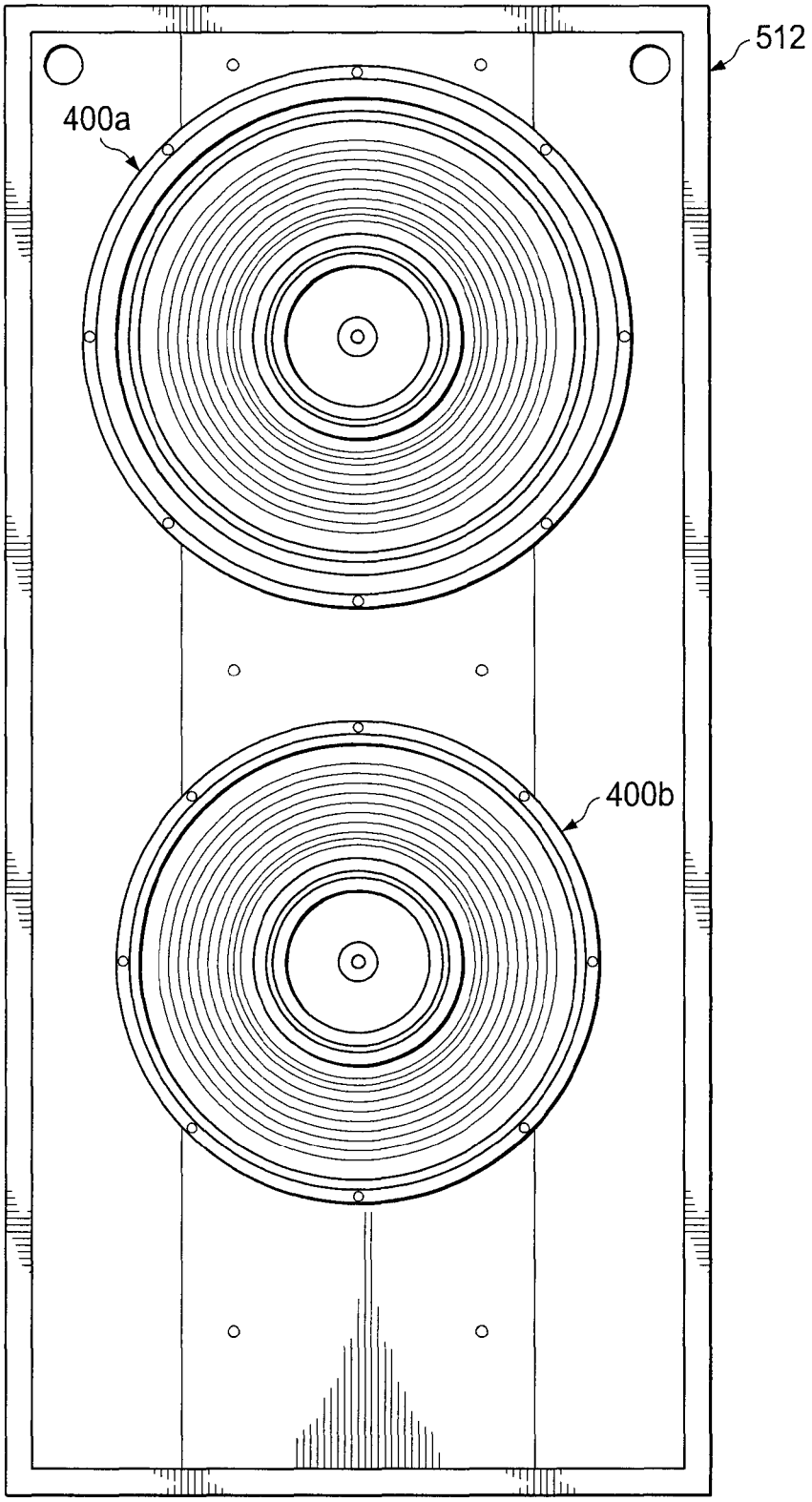
FIG. 5 shows an exemplary speaker having two drivers, each of which has an exemplary speaker cone, according to an embodiment.

FIG. 5 illustrates several speaker driver/diaphragm units 400*a,b* which are mounted in a speaker enclosure 512. Although the enclosure 512 is not required, it may be desired to mount drivers 400*a,b* within a particular speaker enclosure for aesthetic reasons, ease of maintenance and positioning, performance reasons, and so forth. Embodiments of the invention that incorporate a speaker enclosure create a different pressure dynamic than embodiments without a speaker enclosure, as the pressure within the enclosure forces one portion of the diaphragm forward as the other portion moves towards the rear of the enclosure. Embodiments of the invention may include multiple driver/diaphragm units within a single enclosure so that the sound energy/pressure changes caused by one driver/diaphragm may be captured and used to create sound by the stabilizing portion of the other units. In some situations, this dynamic may be used to create a surround sound system having various inputs channels representing left, right, center, etc. feeds.

Particular Embodiment of the Invention

Figure 6:
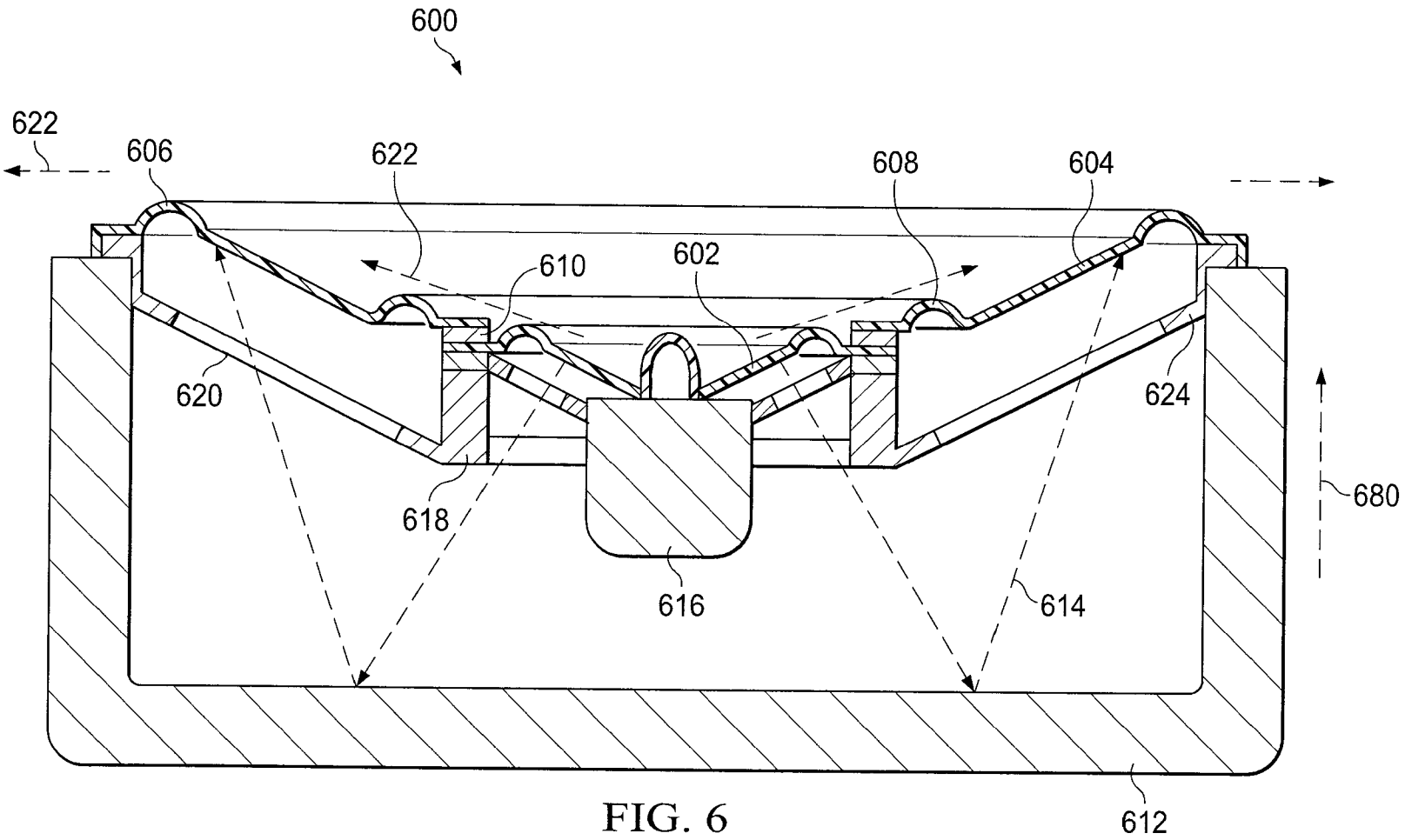
FIG. 6 illustrates a top-down cross-sectional view of a particular embodiment of the claimed invention.

Referring to FIG. 6, a particular implementation/embodiment of the invention is illustrated and described. The active part 602 of the diffuser is the source of sound. Its diameter may be specifically selected according to the desired characteristics in combination with the stabilizing part 604 of the diffuser. The stabilizing part 604 widens the diapason (i.e. range) of played back frequencies from the originating active part.

The stabilizing part of the diffuser may have a ring shape and may comprise any suitable material. Both sides of the stabilizing part include corrugated edges which in turn form two hangers—upper hanger 606 and lower hanger 608. The hangers allow the stabilizing part to have a high degree of motion and stability during operation while paired with the active part. Upper hanger 606 may be attached to a metal caging/basket, while the lower hanger 608 may be attached to a mounting ring, which is located proximal to the active part.

A mounting ring 610 may be made of pressed cardboard. The ring is configured for the mounting of the lower corrugated hanger of the stabilizing part. The caging 620 may be made of steel, and is configured to provision the assembly of all conventional speaker parts such as permanent magnet, etc.

A mounting cylinder may be made from aluminium or derivatives.

The permanent magnet is illustrated by reference numeral 616.

The direction of sound energy emission is at the back side of the active diffuser 602 as the active diffuser moves toward the direction of the back of the cabinet. The cabinet/enclosure is illustrated by reference numeral 612.

The above components and configuration are related to one particular embodiment of the claimed invention. The components may be made from any suitable material and configured as appropriate for a particular embodiment. The above description with respect to FIG. 6 is for example purposes only, and in no way is it intended to narrow the scope of the claimed invention.

Figure 7A:
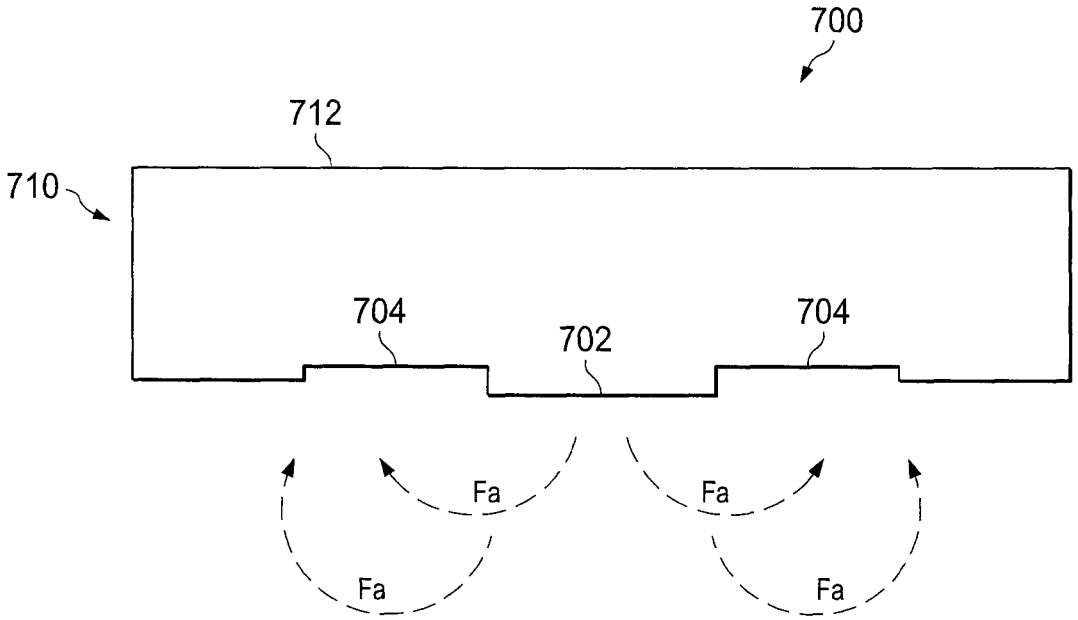
FIG. 7A-FIG. 7B illustrate, as an example, some of the forces that may operate on the inner and outer components of an exemplary diaphragm according to an embodiment of the invention.
Figure 7B:
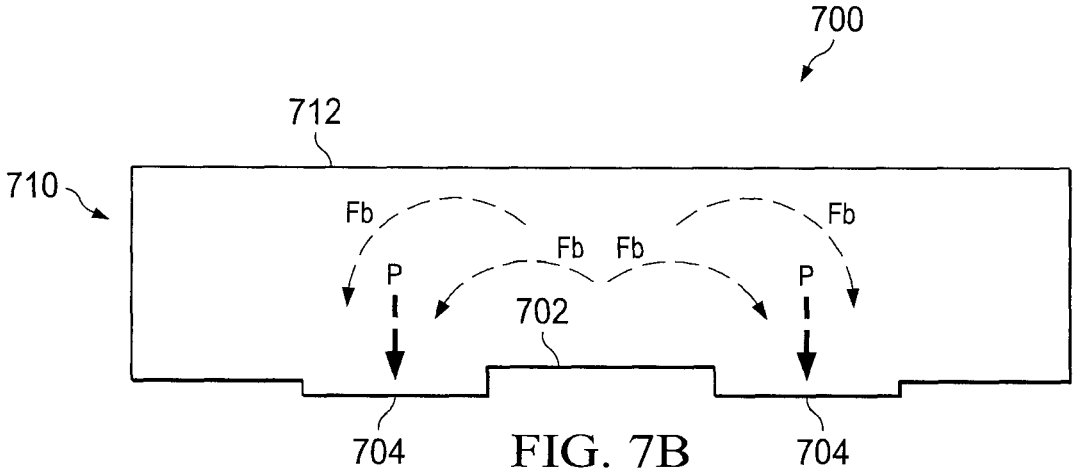
Figure 8:
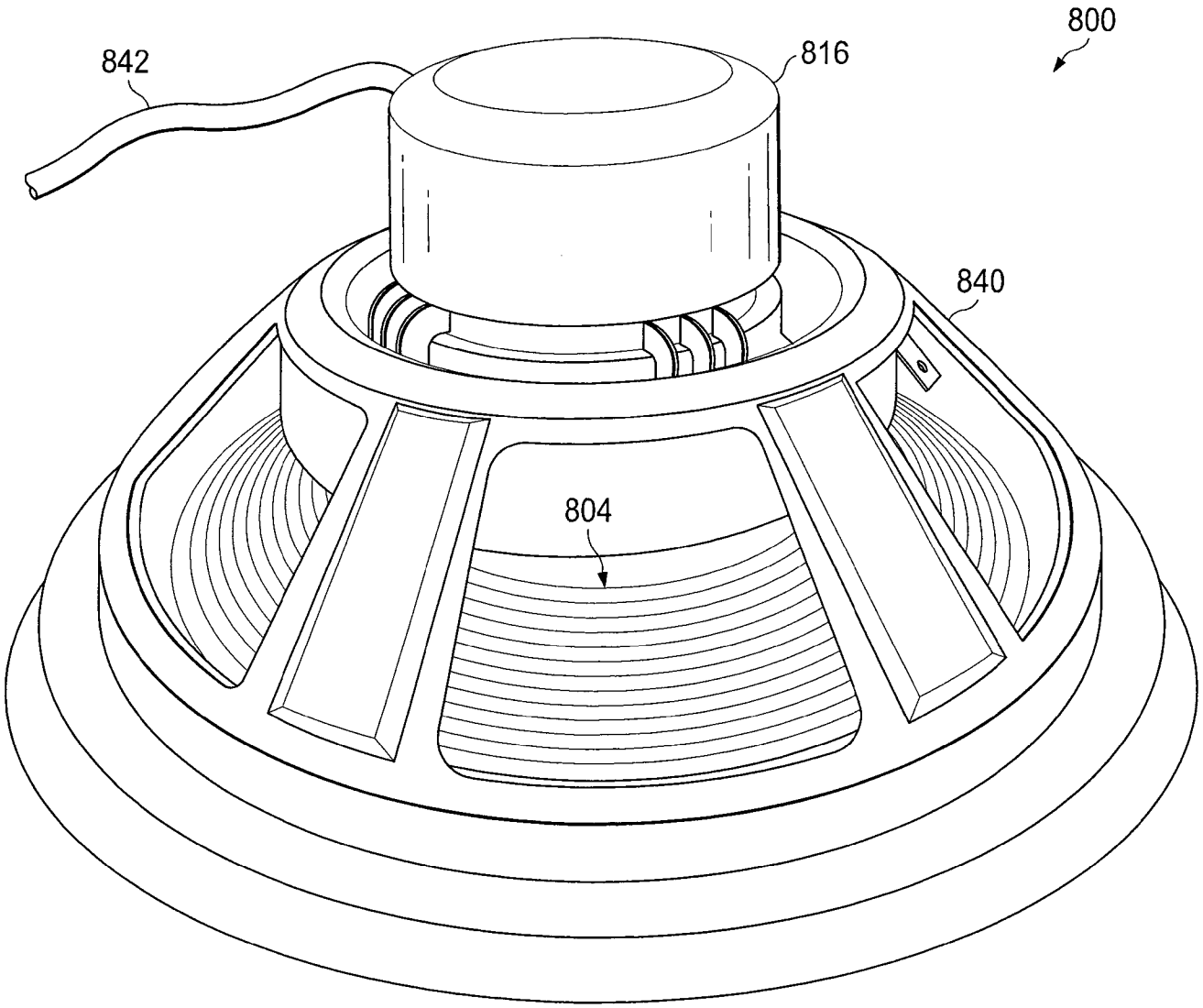
FIG. 8 illustrates a side view of a speaker according to an embodiment of the invention.

Referring to FIGS. 7*a* and 7*b*, some forces that may tend to impact the speaker of the invention are shown, according to various embodiments. The figures show a top-down cross-sectional view. Each figure shows the same speaker 700 at a particular moment of time and various components such as certain electronic components and mechanical components are omitted for the purpose of illustrating the relative movement of the active portion 702 and the stabilizing portion 704. The speaker 700 includes a speaker enclosure 710 having a rear wall 712. The active portion 702 moves back and forth (i.e. in the direction of the rear wall 712 and in the opposite direction) according to the interaction of the magnets (not shown) which are coordinated by an electrical input.

FIG. 7*a* shows the active portion at a moment of time as it moves away from the rear wall. The movement of the active portion creates acoustic forces Fa which tend to move the stabilizing portion toward the rear wall. This symbiotic relationship allows the stabilizing portion to absorb energy created by the active portion and to produce sound. Also, in some embodiments, the movement of the active portion away from the rear wall momentarily lowers the pressure within the enclosure, meaning the stabilizing portion will experience less pressure resistance from within the enclosure as the forces Fa push the stabilizing portion toward the rear wall. The environmental pressure outside the enclosure 710 may also push the stabilizing portion toward the rear wall if the pressure within the enclosure is less than the environmental pressure.

FIG. 7*b* shows the active portion at a moment of time as it moves toward the rear wall. The movement of the active portion increases the pressure within the enclosure creating forces P that move the stabilizing portion away from the rear wall. Furthermore, acoustic forces Fb are created that tend to also move the stabilizing portion away from the rear wall. The forces Fb and P allow the stabilizing portion to recover a substantial amount of useful energy created by the movement of the active portion which is converted into useful sound.

As indicated above, it will be appreciated that while in operation, the inner and outer portions 702, 704 are in constant movement and thus the relative positions (which are approximate and for exemplary purposes only) are shown in FIGS. 7*a* and 7*b* for two particular moments in time.

A person skilled in the art will recognize that the acoustic forces Fa and Fb (i.e. vibrations) do not travel by the paths indicated in FIGS. 7*a,b* as the energy movement and interaction is a complex phenomenon within and outside the enclosure; rather, the paths of acoustic forces Fa and Fb in FIGS. 7*a,b* are merely shown to illustrate the effect that the forces created by the movement of the active portion in one direction tend to impart resultant forces on the stabilizing portion in the opposite direction.

Some Features and Benefits of Embodiments of the Invention

Embodiments of the invention provide various advantages over prior art technology, including: a. Greater efficiency compared to prior art speakers—some embodiments of the invention have increased speaker efficiency to 15% and greater compared to 5% efficiency in some prior art speakers;

b. High quality sound can be created with minimal speaker enclosure or no enclosure at all. This saves a great deal of cost on speaker construction as well as the creation of far lighter speakers that are easier to move; some embodiments of the invention may also incorporate speaker enclosures to provide particular characteristics and to leverage the relatively constant volume of air within the enclosures.

c. A higher frequency range is possible with embodiments of the invention; and d. Expensive equipment such as amplifiers, receivers, frequency splitters, and enclosures may be minimized or eliminated in systems incorporating embodiments of the invention.

ADDITIONAL COMMENTARY AND EXPLANATION

The active portion sets forces in motion as the active part is driven back and forth. The stabilizing portion reacts to the forces created by the active portion's movement, allowing the stabilizing part to create sound though recovery of energies of vibration as well as air displacement variations from the active part.

Certain configurations of the invention may yield varying performance. For example, implementations involving a sealed enclosure may allow for the recovery of more energy than open configurations given that the stabilizing portion will react significantly to the active portion's movement as the volume of air in the sealed enclosure is substantially prevented from escaping.

In some embodiments, a plurality of diaphragm/driver units such as shown in FIG. 1 may be used to complement each other. As an example, two such speakers in the same enclosure may receive a separate audio channel. Each speaker will not only produce the sound inputted to itself but may also pick up the energies from the other speaker through the stabilizing parts thus emitting frequencies missing from each input. This allows the speakers to work in tandem which combines both sound and range. Such a configuration may be implemented to create a highly efficient surround sound system where one speaker receives, for example the left signal, and the other speaker receives, for example the center signal. Various other combinations can be readily implemented by using embodiments of the invention in different configurations.

In use, the stabilizing portion of the invention creates sound from energies that are lost in prior art speakers. Energies that were parasitic in nature because of prior art designs have often been eliminated prior art speakers (by design and/or through collisions) despite representing natural sound. Prior art speakers suffered from greater frequency cancelling because of sound collisions within the walls of enclosures, materials and other components which substantially reduced the reproduction of natural sound. Frequency cancelling is minimized in embodiments of the invention because energy created by the active portion may be harnessed by the stabilizing portion, thus allowing embodiments of the invention to create more natural sound in a more efficient manner.

The invention allows the stabilizing portion to collect and utilize energies created by the active portion, thus reducing the opportunity to negatively affect sound output and to capitalize on them which reduces power consumption as less input energy is required to produce the same amount of sound.

Embodiments of the invention mitigate the need for much stereo/sound system components such as filters, crossover parts of receivers, etc. that split sound then recombine it all with the aid of digital components/software in an attempt to make the final sound as natural as possible.

The stabilizing portion is not an active component in the sense that it is not directly driven by an electrical component; however, the stabilizing portion does create sound from air pressure variations created by the active portion through air volume stabilizing. Also, the stabilizing portion creates sound from vibrations emitted by active part. Embodiments of the invention utilize both air stabilizing effects and vibrational energies that were purposively eliminated or were eliminated as a by-product of prior art speaker design.

SUMMARY

Embodiments of the invention are disclosed that incorporate a diaphragm having an active part and a stabilizing part. The active part is driven back and forth by the interaction of magnets according to an electrical input signal. The stabilizing part moves as a result of forces that are created by the active part in motion. The active part creates forces that cause the stabilizing part to move in the opposite direction of the active part. These forces in turn allow the stabilizing part to create usable sound instead of wasting much of the energy produced by the active part though acoustic wave collision and acoustic collisions with speaker enclosures as found with prior art speakers.

The movement of the active and stabilizing parts thus operate in a symbiotic fashion which allows high quality sound to be created in an efficient manner across a wide range of frequencies.

Embodiments of the invention are not limited to any particular materials, geometry of design or dimensions. The quality of the sound produced by embodiments of the invention may be improved by selecting particular materials, dimensions and other design parameters. Embodiments of the invention may use speaker enclosures and their design may also compliment speaker performance and allow for more enhancements.

While the embodiments have been described with reference to examples, those skilled in the art will be able to make various modifications to the described embodiments without departing from the scope of the claimed embodiments.

What is claimed is:

1. An acoustic speaker for converting an electrical signal into sound, the speaker comprising:

a speaker enclosure, a cradle in the speaker enclosure, at least one permanent magnet and at least one electromagnet to receive an electrical signal;

a diaphragm configured to move back and forth according to the interaction of the magnets, the diaphragm comprising an inner component and an outer component, the inner component being positioned proximal to electromagnet and the outer component being positioned distal to the electromagnet, the outer edge of the inner component flexibly attached to the cradle via a first hinge, and the inner edge of the outer component flexibly attached to the cradle via a second hinge, such that the inner component and the outer components may move relative to each other in opposite directions;

in which the inner and outer components move off-phase relative to each other such that the volume of air displaced is substantially equal on both sides of the diaphragm.

2. The speaker of claim 1 in which the inner component and the outer component have inner and outer edges which are substantially circular in shape.

3. The speaker of claim 2 in which the permanent magnet, electromagnet and attached diaphragm are mounted in the speaker enclosure.

4. The speaker of claim 3 in which the inner and outer components of the diaphragm are integrally constructed.

5. The speaker of claim 4 in which the inner component is integrally constructed with a housing that encloses the permanent magnet.

6. The speaker of claim 1 in which the result of the displaced volume of air being substantially equal on both sides of the diaphragm minimizes acoustic short circuit.

7. The speaker of claim 1 in which the efficiency of the speaker is greater than 15%.

8. The speaker of claim 1 in which the range of sound produced is within the full range of sound perceptible by the human ear.

9. The speaker of claim 8, in which the relative sizes (area) of the inner and outer portions may be selected to minimize acoustic distortion and/or to provide enhanced performance.

10. An acoustic speaker for converting an electrical signal into sound, the speaker comprising:

at least one driver for producing sound, the driver comprising an electromagnet;

a circular diaphragm attached to the at least one driver having a circular flange, the flange fixed in place relative to the driver, the diaphragm comprising a flexible inner component and a flexible outer component, the inner component being positioned proximal to the driver and the outer component being positioned distal to the driver, the outer edge of the inner component flexibly attached to the flange via a first hinge, and the inner edge of the outer component flexibly attached to the flange via a second hinge, such that the outer component may move relative and opposite to the direction the driver causes the inner component to move;

in which the inner and outer components move back and forth off-phase relative to each other in the longitudinal direction of the speaker driver, and in which the volume of air displaced at any one time remains relatively constant on either side of the diaphragm such that acoustic distortion is reduced.

11. An acoustic speaker for converting an electrical signal into its corresponding sound, the speaker comprising:

at least one electromagnet and at least one permanent magnet;

a diaphragm configured to move back and forth to create sound depending on the interaction between the electromagnet and the permanent magnet, the interaction controlled by an electrical input signal;

the diaphragm comprises an active component proximal to the electromagnet and a stabilising component distal from the electromagnet, the active component being separated from the stabilizing component via a hinge mechanism comprising a fixed ring, a first hinge and a second hinge, wherein the active component is attached to the fixed ring via the first hinge and the stabilizing component is attached to the fixed ring via the second hinge;

wherein the movement of the active component to create sound creates corresponding forces on the stabilizing component such that the two components move relative to each other and in the opposite directions.

12. The acoustic speaker of claim 11 in which the movement of the stabilizing component creates sound as the active component creates sound.

13. The acoustic speaker of claim 11 in which the forces may include air pressure and the forces exerted by sound waves.

14. The acoustic speaker of claim 11 in which the stabilizing component is caused to move by the forces created by the movement of the active component.

15. The acoustic speaker of claim 10, wherein the flange is a mounting ring and the first and second hinges are hangers.

16. The acoustic speaker of claim 15, wherein the hangers are corrugated.

* * * * *